US007520672B2

(12) United States Patent
Thangamani et al.

(10) Patent No.: US 7,520,672 B2
(45) Date of Patent: Apr. 21, 2009

(54) COOLING ASSEMBLY FOR AN X-RAY TUBE

(75) Inventors: Arunvel Thangamani, Tirunelveli (IN); George Parampil, Karnataka (IN); Ram Turaga, Karnataka (IN)

(73) Assignee: General Electric Company, Schenectady, NY (US)

( * ) Notice: Subject to any disclaimer, the term of this patent is extended or adjusted under 35 U.S.C. 154(b) by 184 days.

(21) Appl. No.: 11/278,193

(22) Filed: Mar. 31, 2006

(65) Prior Publication Data

US 2007/0237301 A1 Oct. 11, 2007

(51) Int. Cl.
*H01J 31/12* (2006.01)

(52) U.S. Cl. ..... 378/199; 378/200

(58) Field of Classification Search ..... 378/119, 378/130, 141, 199, 200
See application file for complete search history.

(56) References Cited

U.S. PATENT DOCUMENTS 4,945,562 A 7/1990 Staub
5,703,926 A 12/1997 Bischof
5,883,936 A 3/1999 Hell et al.
6,074,092 A * 6/2000 Andrews ..... 378/200
6,084,942 A 7/2000 Hell et al.
6,192,107 B1 * 2/2001 Price et al. ..... 378/130
6,213,639 B1 * 4/2001 Hell et al. ..... 378/200
6,249,569 B1 6/2001 Price et al.
6,364,527 B1 * 4/2002 Kutschera ..... 378/200
6,396,901 B1 5/2002 Hell et al.
6,426,998 B1 7/2002 Hell et al.
6,496,564 B2 12/2002 Price et al.
7,025,502 B2 * 4/2006 Freudenberger et al. .... 378/200

* cited by examiner

*Primary Examiner*—Irakli Kiknadze

(57) ABSTRACT

A cooling assembly for an X-ray tube with a stationary body comprising a rotating body located at least around a part of the stationary body, and at least one coolant circuit with at least one coolant flowing through it. The coolant circuit is preferably interposed between the rotating body and the stationary body, with the coolant flowing between the rotating body and the stationary body.

25 Claims, 3 Drawing Sheets

COOLING ASSEMBLY FOR AN X-RAY TUBE

BACKGROUND OF THE INVENTION

This invention relates generally to a cooling assembly, and more particularly to, a cooling assembly for an X-ray tube for transferring heat away from components of the X-ray tube. The X-ray tube with cooling assembly can be used in applications related to medical diagnostics, industrial imaging and crystallography.

In an X-ray tube, a beam of electrons is directed through a vacuum, across very high voltage, from a cathode to a focal spot position on an anode. X-rays are produced as electrons strike the anode, comprising a refractory metal track, such as tungsten, molybdenum or rhodium. However, the conversion efficiency of X-ray tubes is quite low, typically less than 1% of the total power input. The remainder, in excess of 99% of the input electron beam power, is converted into thermal energy or heat.

Accordingly, heat removal or other effective procedures for managing heat tends to be a major concern in the design and operation of an X-ray tube. Very high temperatures in the X-ray tube can result in increased cooling times, target melt, and anode bearing lubricant delamination and/or evaporation. These cooling problems result in X-ray tubes having lower power capability, larger anodes and increased load on the anode bearings, larger heat exchangers, and higher flow rates of coolant. To attain a higher power capability of an X-ray tube, a larger anode is typically required, resulting in a larger X-ray tube.

Some of the solutions in the prior art for removing heat from or cooling X-ray tubes include rotating the target and increasing heat storage capacity by attaching a piece of graphite to the target. Attempts have been made to cool the target convectively by passing a coolant through the anode. One disadvantage of this method is the requirement of a non-contact or contact seal to seal a vacuum region between the anode and frame of the X-ray tube. Another method in the prior art attempts to cool the target by attaching the target to the X-ray tube frame assembly and rotating the frame assembly. This would require a high capacity motor with high power requirements to rotate the frame assembly and also beam deflection technology to deflect the electron beam on the target to obtain a good focal spot.

Thus, it is desirable to provide a cooling assembly for an X-ray tube, which provides excellent thermal efficiency, and is easy to manufacture, less expensive and less complicated from prior art cooling systems. There also exists a need for adapting an efficient cooling assembly to existing X-ray tubes without having to completely redesign the existing X-ray tubes.

SUMMARY OF THE INVENTION

The above-mentioned shortcomings, disadvantages and problems are addressed herein which will be understood by reading and understanding the following specification.

The present invention provides an X-ray tube with a cooling assembly having significantly higher heat transfer rates than prior art X-ray tubes, making it possible to design higher power X-ray tubes without increasing the anode size or requiring more heat resistant anode bearings.

In one embodiment, a cooling assembly for an X-ray tube with a stationary body comprising a rotating body located at least around a portion of the stationary body, and at least one coolant circuit with at least one coolant flowing through it. The at least one coolant circuit is preferably interposed between the rotating body and the stationary body, with the at least one coolant flowing between the rotating body and the stationary body.

In another embodiment, a cooling assembly for an X-ray tube with an X-ray tube frame comprising a rotating body located at least around a portion of the X-ray tube frame, and at least one coolant circuit including at least one coolant interposed between the rotating body and the X-ray tube frame.

In yet another embodiment, an X-ray tube comprises a vacuum housing unit, a cathode coupled within said housing unit and generating an electron beam, an anode coupled within said housing unit and receiving said electron beam and generating X-rays that are directed through an X-ray tube, and an X-ray tube cooling assembly comprising a rotating body located at least around a part of the vacuum housing and X-ray tube casing, and having at least a coolant circuit comprising at least one coolant, interposed between the rotating body and a stationary body.

In still yet another embodiment, an X-ray tube comprising a vacuum housing, a cathode coupled within the vacuum housing and generating an electron beam, an anode target within the vacuum housing coupled to an anode frame, the anode target receiving the electron beam from the cathode and generating X-rays that are directed through a window in the X-ray tube, and a cooling assembly including a rotating body located around the anode frame.

In a further embodiment, an X-ray tube with a cooling assembly comprising a frame enclosing a cathode and a first portion of an anode, an anode frame coupled to the frame and extending around a second portion of the anode, an anode drive assembly coupled to the anode for rotating the first portion of the anode, a rotating body positioned around the anode drive assembly and the anode frame, and at least two coolant circuits including at least two coolants for cooling the X-ray tube.

In a still further embodiment, an X-ray tube with a cooling assembly comprising a vacuum housing enclosing a cathode and a first portion of an anode therein, and a rotating body rotating around a second portion of the anode. The second portion of the anode includes a plurality of circular projections extending radially outwardly therefrom. The rotating body rotates around the circular projections on the second portion of the anode.

Various other features, objects, and advantages of the invention will be made apparent to those skilled in the art from the accompanying drawings and detailed description thereof.

DETAILED DESCRIPTION OF THE INVENTION

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the invention.

In various embodiments, the X-ray tube cooling assembly according to this invention comprises a rotating body located around a portion of a stationary body of the X-ray tube and including at least one coolant circuit having at least one coolant circulating between the rotating body and the stationary body of the X-ray tube.

The present invention provides an X-ray tube with a cooling assembly having significantly higher heat transfer rates (by convection) than prior art X-ray tubes, making it possible to use higher power X-ray tubes without increasing the anode size or requiring more heat resistant anode bearings.

Figure 1:
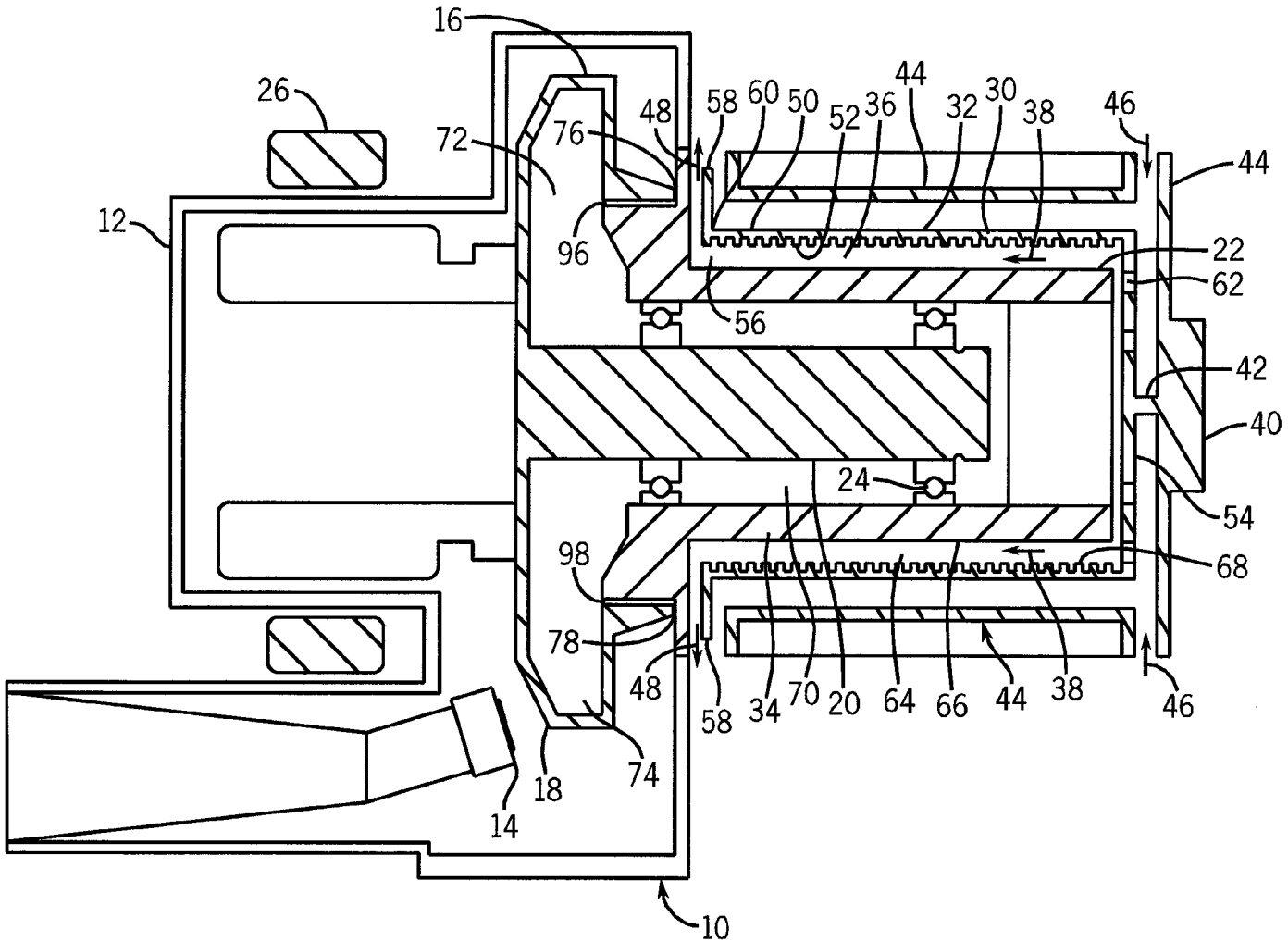
FIG. 1 is a cross-sectional view of an X-ray tube with a cooling assembly in accordance with an embodiment of the present invention.

FIG. 1 shows a partial cross-sectional view of an X-ray tube 10 with a cooling assembly 30 in accordance with an embodiment of the present invention. The X-ray tube 10 comprises a vacuum housing 12 enclosing a cathode 14 and a portion of an anode 16. The cathode 14 is powered with high voltage and emits an electron beam toward the anode 16. The anode 16 receives the electron beam from the cathode 14 and generates X-rays that are directed through a window in the X-ray tube 10. The anode 16 preferably includes a rotating target 18, a shaft 20 extending axially from one side of rotating target 18, and a frame 22 extending around and coupled to shaft 20 with a plurality of bearings 24. The frame 22 is preferably coupled to vacuum housing 12. The X-ray tube 10 also includes an anode drive assembly 26 for rotating the anode target 18 about a rotational axis. The anode drive assembly 26 is preferably a high efficiency induction motor coupled to anode 16.

The cooling assembly 30 is provided around a portion of the X-ray tube 10. The cooling assembly 30 preferably includes a rotating body 32 positioned around a portion of a stationary body 34 of the X-ray tube 10 and at least one coolant circuit 36 including at least one coolant 38 interposed between rotating body 32 and stationary body 34. The rotating body 32 is preferably coupled to a rotating body drive assembly 40 for rotating the rotating body 32 about a rotational axis. The rotating body drive assembly 40 is preferably coupled to rotating body 32 through a shaft 42 attached to a closed end 54 of rotating body 32 for rotating the rotating body 32 around the stationary body 34 of the X-ray tube. The cooling assembly 30 is preferably attached to a support assembly 44 for supporting the rotating body 32 on the X-ray tube. The support assembly 44 preferably includes at least one coolant inlet 46 and at least one coolant outlet 48 for the at least one coolant circuit 36 and at least one coolant 38 to flow. The support assembly 44 may comprise any configuration for supporting a rotating body on a fixed body.

The stationary body 34 preferably comprises a vacuum housing on the X-ray tube, an X-ray tube frame supporting X-ray tube components, and/or an anode frame supporting the anode. The rotating body 32 is preferably a disk, a hollow cylindrically shaped body or a combination of the two, or any similar structure. The rotating body 32 preferably includes an outer surface 50, an inner surface 52, a closed end 54 at one end thereof, and an open end 56 at the opposite end thereof. The rotating body 34 also preferably includes a flange 58 extending outwardly and radially from an edge 60 of the open end 56 for aiding flow of the at least one coolant 38 through the at least one coolant circuit 36. The rotating body 32 preferably includes at least one opening 62 extending through the closed end 54 thereof for allowing the at least one coolant 38 to flow between rotating body 32 and stationary body 34.

The at least one coolant circuit 36 is provided for circulating the at least one coolant 38 between rotating body 32 and stationary body 34. The at least one coolant circuit 36 allows the at least one coolant 38 to circulate through an open area 64 between rotating body 32 and stationary body 34. The at least one coolant 38 flowing around an outer surface 66 of stationary body 34 extracts heat from the X-ray tube. The at least one coolant 38 may be circulated through a heat exchanger (not shown) to remove heat from the at least one coolant 38 into the environment, and be re-circulated back into the X-ray tube.

The rotating body drive assembly 40 may be either a single phase or a three-phase induction motor directly coupled to rotating body 32 through shaft 42. This induction motor may be a constant speed or a variable speed motor to rotate rotating body 32 at a constant speed or a variable speed. The power required to drive the rotating body is dependent upon the radius of the rotating body and the frequency. The rotating body can be rotated from about 5000 to 10000 rpm depending upon the power, desired cooling rate and X-ray tube design.

The anode drive assembly 26 and rotating body drive assembly 40 may be synchronized with each other or they may run independently of each other, with the rotating body drive assembly 40 including a microcontroller based drive system, which can vary the speed of the motor depending upon the temperature of the at least one coolant.

The cooling assembly 30 further includes a plurality of flow vanes or grooves 68 or any other similar construction formed either on inner surface 52 of rotating body 32 or on outer surface 66 of stationary body 34 to aid the flow of the at least one coolant 38 through coolant circuit 36. The flow vanes or grooves 68 preferably extending inwardly and radially from inner surface 52 of rotating body 32 and/or extending outwardly and radially from outer surface 66 of stationary body 34. A local turbulence flow field is generated in the at least one coolant 38 between rotating body 32 and stationary body 34 due to the shear forces exerted on the at least one coolant 38 by flow vanes or grooves 68. Such local turbulence results in very high convection coefficients. These high convective coefficients ensure a high heat removal rate. The rotation of rotating body 32 around stationary body 34 results in a pressure differential, which along with flow vanes or grooves 68 aid in the flow of the at least one coolant 38 around stationary body 34.

In the embodiment illustrated in FIG. 1, X-ray tube 10 optionally includes a second coolant circuit 70 located within anode 16 and anode target 18, providing a second coolant 72 within an open area 74 formed in anode 16, anode target 18 and frame 22. The second coolant 72 occupies open area 74 within anode 16, anode target 18 and frame 22, surrounding shaft 20 and plurality of bearings 24 for cooling the X-ray tube. This second coolant circuit 70 may further comprise at least one coolant inlet 76 and at least one coolant outlet 78. The at least one coolant inlet 76 is preferably sealed with a seal 96. Likewise, the at least one coolant outlet 78 is preferably sealed with a seal 98.

By way of example, the cooling assembly is provided with at least one coolant circuit having at least one coolant inlet and at least one coolant outlet, through which at least one coolant is circulated. The possible coolants for use in the at least one coolant circuits of this invention may include air, water, fluorocarbon liquids (FC-75, FC-77, etc.), mineral oil, transformer oil, other oils, liquid metals, Gallium alloys, or a variety of organic liquids, such as Dowtherm® organic liquids, etc. The at least one coolant, depending upon the design can be re-circulated through a heat exchanger, which exchanges heat from the at least one coolant to the environment and re-circulates the at least one coolant back into the X-ray tube for further cooling.

Figure 2:
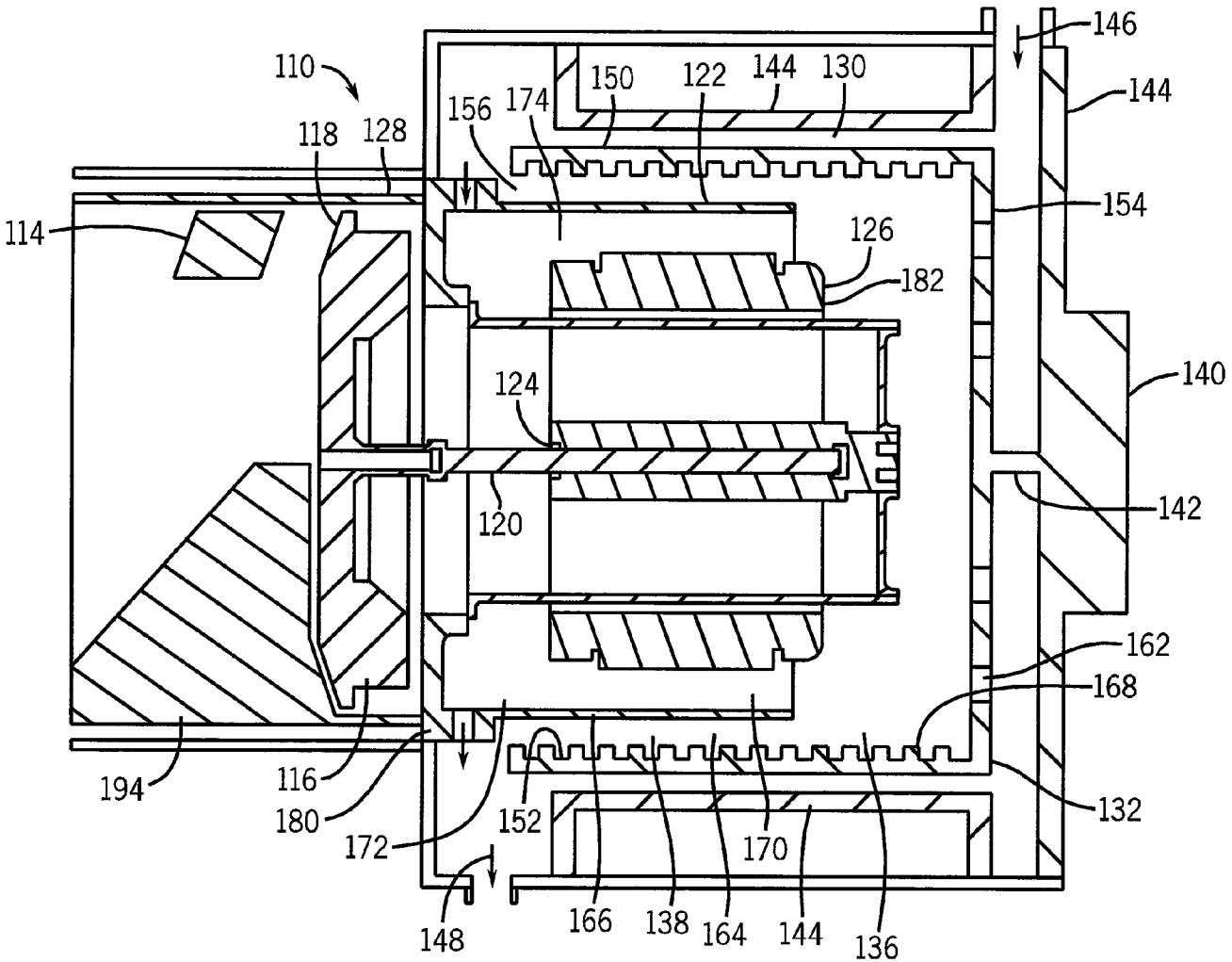
FIG. 2 is a cross-sectional view of an X-ray tube with a cooling assembly in accordance with another embodiment of the present invention.

FIG. 2 illustrates a partial cross-sectional view of an X-ray tube 110 with a cooling assembly 130 in accordance with another embodiment of the present invention. The X-ray tube 110 comprises a frame 128 enclosing a cathode 114, a portion of an anode 116, and a frame to collect backscattered electrons 194. The anode 116 preferably includes a rotating target 118, a shaft 120 coupled to one side of rotating target 118, an anode drive assembly 126 coupled to the shaft 120 through a plurality of bearings 124 for rotating the anode target 118 about a rotational axis, and an anode frame 122 extending around the anode 116 and anode drive assembly 126. The anode frame 122 is preferably coupled to anode drive assembly 126, a backplate 180 and frame 128. The anode drive assembly 126 is preferably a high efficiency induction motor including a stator 182 coupled to shaft 120.

The cooling assembly 130 preferably includes a rotating body 132 positioned around anode drive assembly 126 and anode frame 122, and at least two coolant circuits 136, 170. The rotating body 132 is preferably coupled to a rotating body drive assembly 140 for rotating the rotating body 132 about a rotational axis. The rotating body drive assembly 140 is preferably coupled to rotating body 132 through a shaft 142 attached to a closed end 154 of rotating body 132 for rotating the rotating body 132 around anode frame 122. The cooling assembly 130 is preferably attached to a support assembly 144 for supporting the rotating body 132 on the X-ray tube. The support assembly 144 preferably includes at least one coolant inlet 146 and at least one coolant outlet 148 for a second coolant circuit 136 and a second coolant 138 to flow. The support assembly 144 may comprise any configuration for supporting a rotating body on a fixed body.

The rotating body 132 is preferably a hollow cylinder having an outer surface 150, an inner surface 152, a closed end 154 at one end thereof, and an open end 156 at the opposite end thereof. The rotating body 132 also preferably includes at least one opening 162 extending through the closed end 154 thereof for allowing second coolant 138 to flow between rotating body 132 and anode frame 122.

The first coolant circuit 170 located within anode frame 122 and surrounding anode drive assembly 126 provides a first coolant 172 within an open area 174 between anode frame 122 and anode drive assembly 126 submerging the high efficiency induction motor stator 182 of anode drive assembly 126 in first coolant 172. The second coolant circuit 136 is provided for circulating a second coolant 138 between rotating body 132 and anode frame 122. The second coolant circuit 136 allows second coolant 138 to circulate through an open area 164 between rotating body 132 and anode frame 122. The second coolant 138 flowing around backplate 180, an outer surface 166 of anode frame 122, and stator 182 extracts heat from the X-ray tube. The second coolant 138 may be circulated through a heat exchanger (not shown) to remove heat from second coolant 138 into the environment.

The rotating body drive assembly 140 may be either a single phase or a three-phase induction motor directly coupled to rotating body 132 through shaft 142. This induction motor may be a constant speed or a variable speed motor to rotate rotating body 132 at a constant speed or a variable speed. The anode drive assembly 126 and rotating body drive assembly 140 may be synchronized with each other or they may run independently of each other, with the rotating body drive assembly 140 including a microcontroller based drive system, which can vary the speed of the motor depending upon the temperature of the coolant.

The cooling assembly 130 further includes a plurality of flow vanes or grooves 168 formed either on inner surface 152 of rotating body 132 or on outer surface 166 of anode frame 122 to aid the flow of second coolant 138 through second coolant circuit 136. The flow vanes or grooves 168 preferably extending inwardly and radially from inner surface 152 of rotating body 132 and/or extending outwardly and radially from outer surface 166 of anode frame 122.

The rotating body 132 rotates around anode frame 122, which includes anode drive assembly 126 submerged in first coolant 172. In this embodiment, stator 182 is also cooled by second coolant circuit 136 and second coolant 138. The second coolant 138 flows between rotating body 132 and anode frame 122 over backplate 180, outer surface 166 of anode frame 122, and stator 182. Due to the rotation of rotating body 132, a pressure differential develops, which aids the flow of second coolant 138 through second coolant circuit 136. The flow vanes or grooves 168 also increase the flow rate of second coolant 138 through second coolant circuit 136.

As stated above, the embodiments of FIG. 2 provide for the use of at least two coolant circuits and at least two coolants. The possible coolants for use in the coolant circuits may include air, water, fluorocarbon liquids (FC-75, FC-77, etc.), mineral oil, transformer oil, other oils, liquid metals, Gallium alloys, or a variety of organic liquids, such as Dowtherm® organic liquids, etc.

In another embodiment of FIG. 2, a cooling assembly includes a first coolant circuit with a first coolant that may be re-circulated over a stator of an anode drive assembly, a backplate in an X-ray tube frame, a window in an X-ray tube, and a cathode frame of an X-ray tube. The first coolant circuit comprising at least one coolant inlet in the X-ray tube frame that is sealed with a seal in the X-ray tube frame. The first coolant filling an open area between the X-ray tube frame and anode drive assembly. The cooling assembly further includes a second coolant circuit with a second coolant that may be re-circulated between a rotating body and the X-ray tube frame. The second coolant circuit comprising at least one coolant inlet and at least one coolant outlet for re-circulating the second coolant through the second coolant circuit and a heat exchanger to remove heat from the second coolant into the environment.

Figure 3:
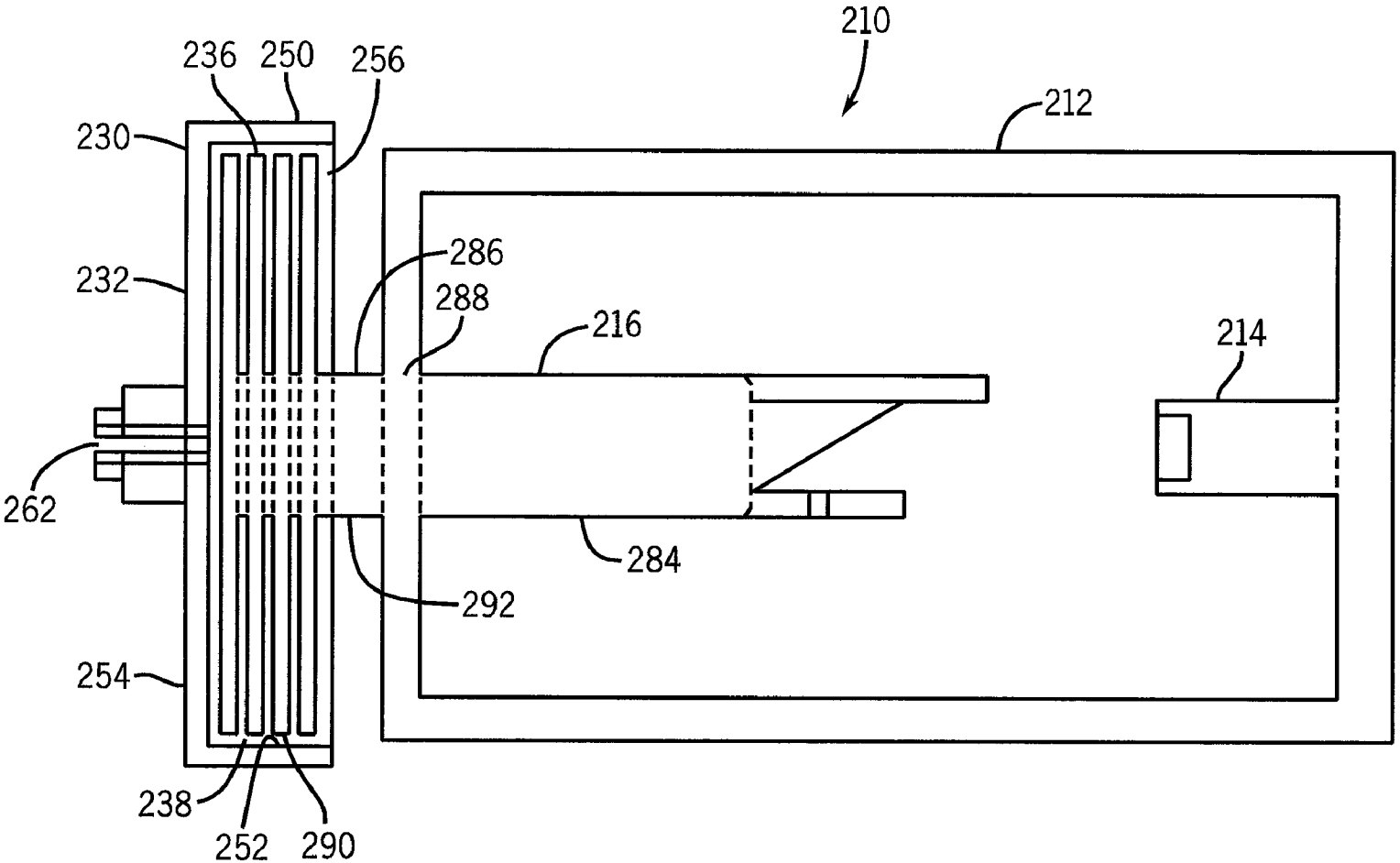
FIG. 3 is a cross-sectional view of an X-ray tube with a cooling assembly in accordance with yet another embodiment of the present invention.

FIG. 3 illustrates a partial cross-sectional view of an X-ray tube 210 with a cooling assembly 230 in accordance with yet another embodiment of the present invention. In this embodiment, the X-ray tube 210 comprises a vacuum housing 212 enclosing a cathode 214 and a first portion 284 of an anode 216. The anode 216 is preferably stationary and in addition to the first portion 284, includes a second portion 286 that extends out through an opening 288 in vacuum housing 212. The second portion 286 of the anode 216 preferably includes a plurality of circular projections 290 extending radially outwardly from a main body 292 of anode 216.

The cooling assembly 230 preferably includes a rotating body 232 that rotates around the plurality of circular projections 290 extending from the second portion 286 of anode 216. The cooling rate of the X-ray tube 210 is significantly increased by providing rotating body 232 driven by a variable speed controlled motor (not shown) rotating the rotating body around the plurality of circular projections 290. The cooling assembly 230 may optionally include a coolant circuit 236 having a coolant 238 flowing within rotating body 232 and the plurality of circular projections 290. The cooling may be due to natural convection or by means of forced convection. The speed of the rotating body 232 may be varied depending upon the desired cooling rate. This increased convective cooling is caused by creation of a local turbulent flow field within the rotating body 232 as described in the previous embodiments.

The rotating body 232 is preferably a hollow cylinder having an outer surface 250, an inner surface 252, a closed end 254 at one end thereof, and an open end 256 at the opposite end thereof. The rotating body 232 also preferably includes at least one opening 262 extending through the closed end 254 thereof for allowing the coolant 238 to flow within rotating body 232 and the plurality of circular projections 290.

Preliminary simulations were performed on various embodiments of the invention using commercial computational heat transfer codes (IDEA ESC), assuming a fluid volume with an outer rotating boundary and an inner non-rotating boundary, showing a substantial increase in convection coefficients and higher heat removal rates compared to prior art designs.

Some of the advantages of the invention include: 1) lower anode and target temperatures avoiding focal spot melting and anode bearing lubricant evaporation; 2) lower anode cooling times leading to efficient thermal management and better utilization of the X-ray tube; and 3) the capability to handle higher peak power loads for applications in computed tomography (CT) and vascular medical imaging systems.

Various embodiments of this invention provide a cooling assembly for an X-ray tube and the resulting X-ray tube incorporating the cooling assembly as herein described. However, the embodiments are not limited and may be implemented in connection with different rotating anode X-ray tube configurations (CT, vascular) and stationary anode tiny tube heads. The application of the invention can be extended to other areas, for example, industrial imaging, etc.

While the invention has been described with reference to preferred embodiments, those skilled in the art will appreciate that certain substitutions, alterations and omissions may be made to the embodiments without departing from the spirit of the invention. Accordingly, the foregoing description is meant to be exemplary only, and should not limit the scope of the invention as set forth in the following claims.

What is claimed is:

1. A cooling assembly for an X-ray tube with a stationary body comprising:

a rotating body located at least around a portion of the stationary body; and at least one coolant circuit including at least one coolant interposed between the rotating body and the stationary body;

wherein the stationary body includes a vacuum housing.

2. The assembly as in claim 1, wherein the rotating body is a hollow body.

3. The assembly as in claim 1, wherein the rotating body rotates around the stationary body creating turbulence in the coolant of the coolant circuit.

4. The assembly as in claim 1, wherein the coolant circuit further includes at least one coolant inlet and at least one coolant outlet through which the at least one coolant is circulated.

5. The assembly as in claim 1, wherein the at least one coolant is selected from a group comprising air, water, oil, fluorocarbon liquids, liquid metals or organic liquids.

6. The assembly as in claim 1, further comprising a rotating body drive assembly for rotating the rotating body about a rotational axis.

7. The assembly as in claim 6, wherein the rotating body drive assembly includes either a single phase or three-phase induction motor driven independently or synchronized to an induction motor for rotating an anode of the X-ray tube.

8. The assembly as in claim 7, wherein the single phase or three-phase induction motor is a constant speed motor.

9. The assembly as in claim 7, wherein the single phase or three-phase induction motor is a variable speed motor.

10. The assembly as in claim 1, wherein the cooling assembly includes a plurality of flow vanes or grooves formed on an inner surface of the rotating body.

11. The assembly as in claim 1, wherein the cooling assembly includes a plurality of flow vanes or grooves formed on an outer surface of the stationary body.

12. An X-ray tube comprising:

a vacuum housing;

a cathode coupled within the vacuum housing and generating an electron beam;

an anode target within the vacuum housing coupled to an anode frame, the anode target receiving the electron beam from the cathode and generating X-rays that are directed through a window in the X-ray tube; and a cooling assembly including a rotating body located around the anode frame;

wherein the anode frame is stationary.

13. The X-ray tube as in claim 12, wherein the cooling assembly further includes at least one coolant circuit interposed between the rotating body and the anode frame.

14. The X-ray tube as in claim 13, wherein the at least one coolant circuit includes at least one coolant flowing between the rotating body and the anode frame.

15. The X-ray tube as in claim 12, wherein the cooling assembly includes a second cooling circuit located within an opening in the anode target and the anode frame.

16. The X-ray tube as in claim 15, wherein the second coolant circuit includes at least one coolant inlet, at least one coolant outlet, and a second coolant.

17. A cooling assembly for an X-ray tube with an X-ray tube frame comprising:

a rotating body located at least around a portion of the X-ray tube frame; and at least one coolant circuit including at least one coolant interposed between the rotating body and the portion of the X-ray tube frames wherein the portion of the X-ray tube frame is stationary.

18. An X-ray tube with a cooling assembly comprising:

a vacuum housing enclosing a cathode and a first portion of an anode therein; and a rotating body rotating around a second portion of the anode;

wherein at least the second portion of the anode is stationary.

19. The X-ray tube as in claim 18, wherein the second portion of the anode includes a plurality of circular projections extending radially outwardly therefrom.

20. The X-ray tube as in claim 19, wherein the rotating body rotates around the circular projections on the second portion of the anode.

21. An X-ray tube with a cooling assembly comprising:

a frame enclosing a cathode and a first portion of an anode;

an anode frame coupled to the frame and extending around a second portion of the anode;

an anode drive assembly coupled to the anode for rotating the first portion of the anode;

a rotating body positioned around the anode drive assembly and the anode frame; and at least two coolant circuits including at least two coolants for cooling the X-ray tube.

22. The X-ray tube as in claim 21, wherein the at least two coolant circuits include a first coolant circuit located within the anode frame and surrounding the anode drive assembly for providing a first coolant within an open area between the anode frame and the anode drive assembly.

23. The X-ray tube as in claim 21, wherein the at least two coolant circuits include a second coolant circuit located between the rotating body and the anode frame for circulating a second coolant in an open area between the rotating body and the anode frame.

24. The X-ray tube as in claim 21, wherein the cooling assembly includes a plurality of flow vanes or grooves formed on an inner surface of the rotating body.

25. The X-ray tube as in claim 21, wherein the cooling assembly includes a plurality of flow vanes or grooves formed on an outer surface of the anode frame.

* * * * *